United States Patent [19]

Chivers

[11] 4,068,348

[45] Jan. 17, 1978

[54] FULLY CONCEALED DOOR HINGE

[75] Inventor: Thomas R. Chivers, Winston-Salem, N.C.

[73] Assignee: Southern Tool Mfg. Co., Inc., Winston-Salem, N.C.

[21] Appl. No.: 678,567

[22] Filed: Apr. 20, 1976

[51] Int. Cl.[2] ..... E05D 3/06

[52] U.S. Cl. ..... 16/129; 16/166; 16/179; 16/164

[58] Field of Search ..... 16/166, 129, 130, 131, 16/179, 164

[56] References Cited

U.S. PATENT DOCUMENTS

| | | | |
|---|---|---|---|
| 2,018,909 | 10/1935 | Anderson | 16/164 X |
| 2,062,840 | 12/1936 | Soss | 16/166 |
| 2,080,597 | 5/1937 | Bates et al. | 16/166 |
| 2,248,972 | 7/1941 | Dumelin | 16/166 |
| 3,231,928 | 2/1966 | Grunert | 16/166 |
| 3,626,548 | 12/1971 | Grunert | 16/166 |
| 3,909,879 | 10/1975 | Grunert et al. | 16/164 |
| 3,978,549 | 9/1976 | Vitt | 16/164 X |

*Primary Examiner*—Andrew V. Kundrat
*Attorney, Agent, or Firm*—Dowell & Dowell

[57] ABSTRACT

A hinge apparatus for furniture and cabinets which is not visible when the door is closed and which includes linkages associated with a control slot for causing the door to follow a definite rationally chosen path during the opening and closing motion of the door as well as the positioning of the door in a desired location relative to the fixed structure with which it is associated.

3 Claims, 21 Drawing Figures

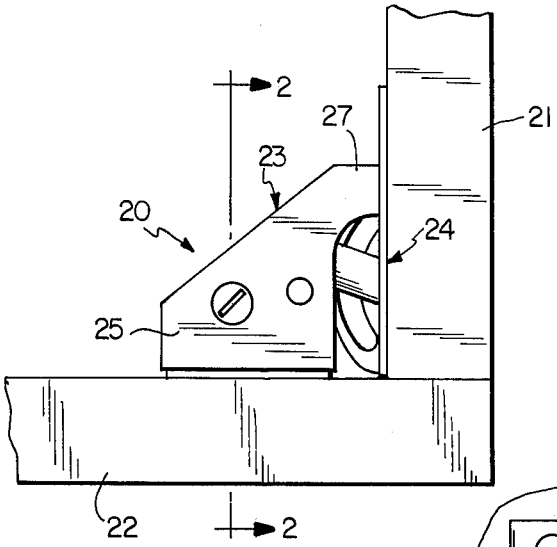
FIG. 1
FIG. 2
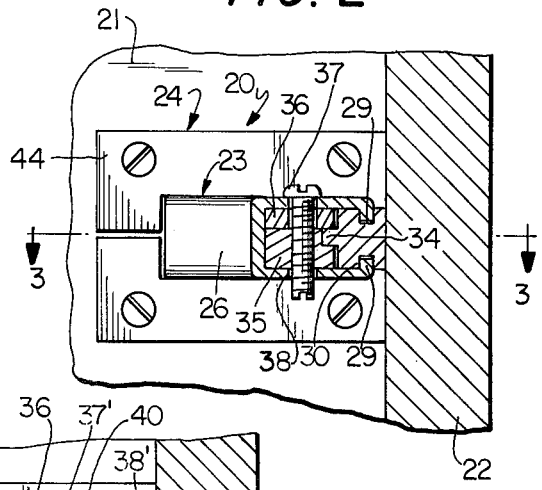
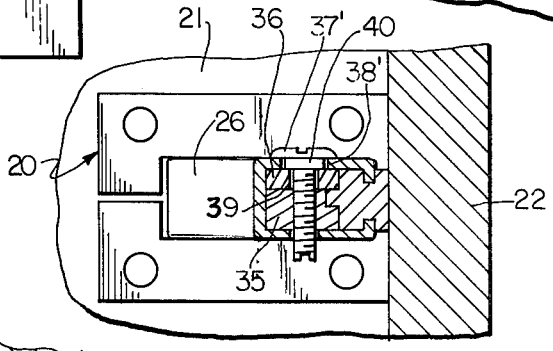
FIG. 5
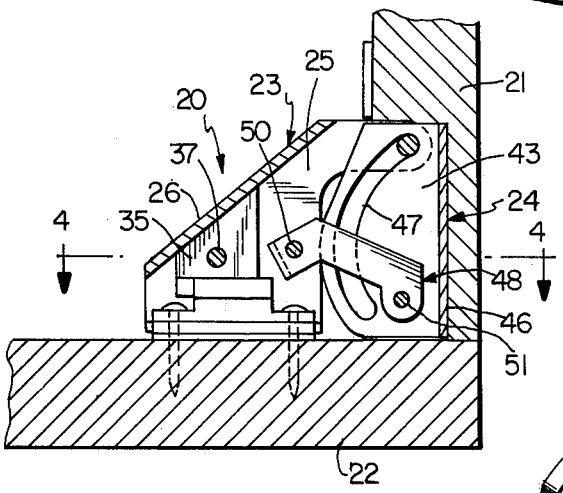
FIG. 3
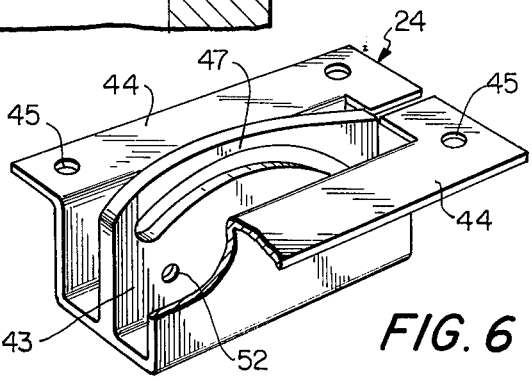
FIG. 6
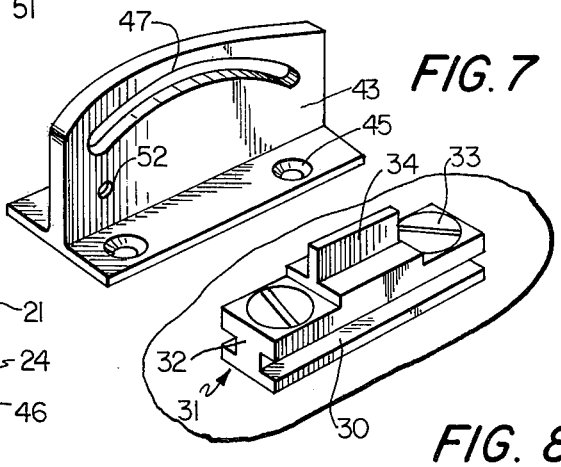
FIG. 7
FIG. 8
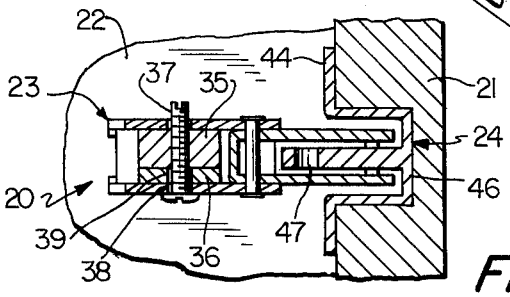
FIG. 4

FULLY CONCEALED DOOR HINGE

BACKGROUND OF THE INVENTION

1. Field of the Invention

This invention relates to hinge members for swingably mounting a door on a fixed structure the plane of which normally is disposed at an angle to the plane of the door and relates particularly to hinge members for mounting doors and the like on furniture and cabinets in which such hinge members are fully concealed when the door is closed.

2. Description of the Prior Art

Heretofore, hinges of various kinds have been provided for swingably mounting one member on another in a manner to permit relative movement. Most hinges have been provided with a pair of leaves having one or more loops or eyes which receive a hinge pin to connect the leaves togther. Normally where doors are concerned, one leaf is mounted on a fixed structure, such as a door frame, and the other leaf is mounted on the trailing edge of the door, while the hinge pin is spaced outwardly from the fixed structure and the door so that the door may swing relative to the fixed structure without interference. With this type of hinge, portions of each of the leaves and the hinge pin are exposed to view on the side toward which the door opens and since substantially all doors of furniture and cabinets open outwardly to afford access to the interior, such hinge portions have been clearly visible.

Some efforts have been made to conceal the hinges by providing apparatus having multiple pivots connected together by linkages, however, these efforts generally have been only partially successful. Normally the prior art efforts have attempted to reposition a primary pivot by a series of sequential motions which locate the primary pivot in a position to permit free swinging movement of the door. These prior attempts have had limited success due to one or more of the following practical difficulties:

1. Loss of door control. In most hinge members having multiple pivot parts, when the primary pivot has reached the desired position, the door is permitted to freely swing about the primary pivot. In such cases the door is free to contact the material of the frame. Also a loss of control problem arises when the structure loses control of the sequence of motions. Thus the sequence of motions does not depend on the linkages but depends on the vectors of force which initiate the opening and closing of the door.

2. Extension of the linkages. Often, in order to achieve a desired path of movement of the door, it was necessary for the connecting linkages to be extended a relatively large distance from the support structure. This permitted normal operating stresses to damage the hinge and resulted in hinges which were larger, heavier, and stronger than should have been required.

3. Failure to be fully concealed. Most of the prior art structures were at least partially visible when the door was closed.

4. Extensive modification of door and frame structure. Extensive door and frame machining or other modifications of an unusual character or beyond the accuracy standards of the industry were frequently required.

Some examples of the prior art are U.S. Pat. Nos. 2,018,909 to Anderson; 2,062,840 to Soss; 2,248,972 to Dumelin; 3,231,928 and 3,626,548 to Grunert.

SUMMARY OF THE INVENTION

The present invention is embodied in a hinge structure for use with either an inset or overset door or other closure member in furniture, cabinets and the like and includes a pair of hinge members which are mounted on a door frame and a door and which are connected for relative movement by a linkage having a pair of pins or pivots. A portion of each of the hinge members is in overlapping relationship with a portion of the other hinge member and one of the hinge members is provided with a control slot while the other hinge member has a fixed member which is slidably received within the control slot. The connecting link and the control slot and fixed member cooperate in such a manner that the hinge controls the motion and positioning of the door at all times from fully closed to fully open positions, so that the door follows a selected rationally chosen path which remains the same each time the door is operated. The hinge members are easily and quickly attachable to the door frame and the door with little or no alteration of the frame and door structures and such hinge members are fully concealed when the door is closed.

It is an object of the invention to provide a relatively simple hinge for use with inset or overset doors of furniture, cabinets and the like in which the hinge is fully concealed when the door is closed an which controls the motion and positioning of the door when the door is opened.

BRIEF DESCRIPTION OF THE DRAWINGS

FIG. 1 is a top plan view of one embodiment of the present invention in use with an inset door.

FIG. 2 is a sectional view on the line 2—2 of FIG. 1.

FIG. 3 is a sectional view on the line 3—3 of FIG. 2.

FIG. 4 is a sectional view on the line 4—4 of FIG. 3.

FIG. 5 is a section view similar to FIG. 2 and illustrating a modification thereof.

FIG. 6 is an enlarged perspective of the movable hinge member.

FIG. 7 is a perspective of another embodiment of the movable hinge member.

FIG. 8 is an enlarged perspective of a mounting member for the fixed hinge member.

DESCRIPTION OF THE PREFERRED EMBODIMENTS

Figure 9:
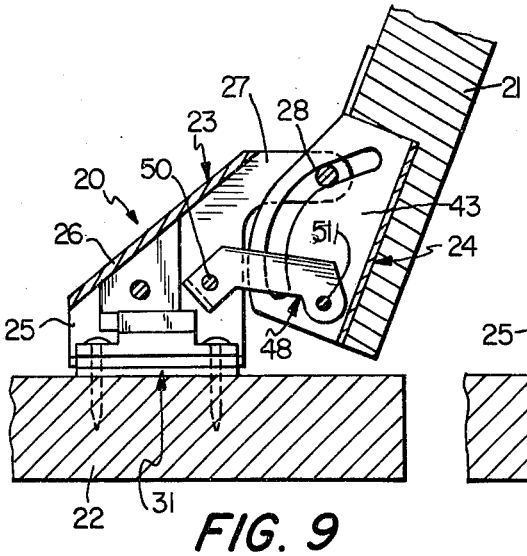
FIGS. 9–13 are sectional views similar to FIG. 3 showing different positions of the hinge members while the inset door is being opened.
Figure 10:
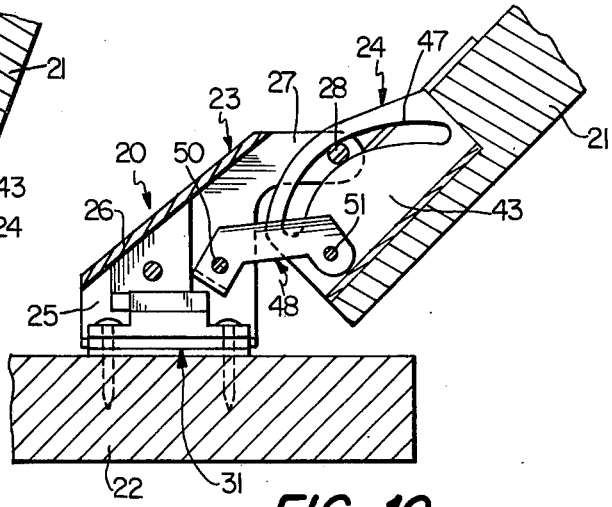
Figure 11:
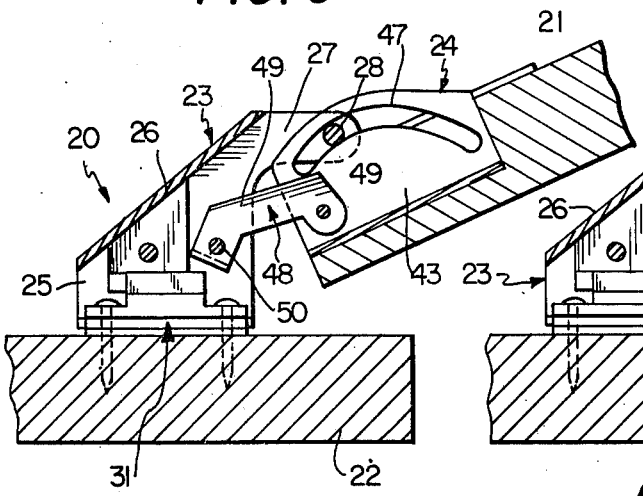
Figure 12:
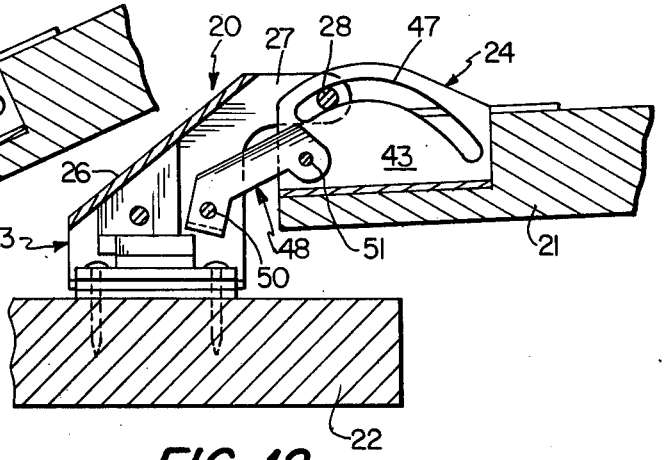
Figure 13:
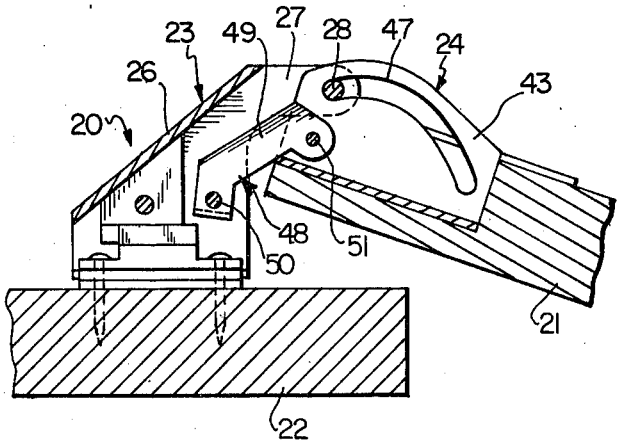

With continued reference to FIGS. 1–13 of the drawings, a hinge 20 is provided for mounting a door or other closure member 21 on a panel, frame, post or other fixed structure 22 of a cabinet or article of furniture. The invention is not limited to use with cabinets and furniture since it is contemplated that the hinge could be used to connect any relatively movable members; however, it is particularly applicable to the cabinet and furniture industries.

The hinge 20 includes a first hinge member 23 which is mounted in fixed adjusted position on the panel 22 and a second hinge member 24 which is mounted on an inset door 21. The first hinge member 23 includes a body which is generally U-shaped in cross-section and has substantially parallel side walls 25 connected by an inclined bight portion 26. Substantially parallel outwardly extending lugs or ears 27 are provided at the upper ends of the side walls and such lugs are connected by a fixed member such as a guide pin 28 for a purpose which will be described later. The lower end of each of the side walls 25 is provided with an inwardly turned flange 29 and such flanges are slidably received within a pair of opposed slots or grooves 30 in a mounting member 31 (FIG. 8).

The mounting member 31 includes a base 32 having openings at opposite ends for receiving conventional screws or other fasteners 33 by means of which the mounting member 31 is attached to the panel 22. The slots or grooves 30 are located along opposite sides of the base 32 and extend the full length thereof. An upwardly extending web or sail 34 is disposed generally longitudinally of the central portion of the base 32.

In order to attach the first hinge member 23 in fixed adjusted position on the mounting member 31, a pair of clamping plates 35 and 36 are located within the body of the first member between the side walls 25 and each of such clamping plates has a portion located along opposite sides of the web or sail 34. With particular reference to FIGS. 2 and 4, a threaded screw 37 extends through openings 38 in each of the side walls 25, through an opening 39 in the clamping plate 36 and threadedly engages the clamping plate 35. When the screw 37 is loose, the first hinge member is freely slidable along the slots 30 and after the hinge member is in a desired position the screw is tightened to cause the clamping plate 35 to frictionally engage the web 34 and resist any additional movement so that the hinge member remains in fixed position.

Ordinarily, a pair of hinges are located along one side wall of a fixed structure and adjacent to the upper and lower surfaces of a cavity or compartment and such hinges are spaced a substantial distance from each other. The screw 37 of each hinge normally is in a generally vertical position and each screw has a head at one end with a screwdriver slot therein for receiving the blade of a conventional screwdriver. If the head of the screw 37 is located adjacent to the upper and lower surfaces of the compartment, it is difficult to apply a screwdriver blade to the screw slot and, accordingly, a second screwdriver slot is provided at the opposite end of the screw shank so that a screwdriver can be applied from either end of the screw.

With particular reference to FIG. 5, a modified form of clamping arrangement is provided in which an opening 38' is located in one of the side walls of the first hinge member and such opening is larger than the opening 38 in the other side wall and the opening 39 in the clamping plate 36. A screw 37' is provided having a shank with an enlargement 40 adjacent to the head which defines a shoulder for engaging the clamping plate 36 so that tightening the screw causes both clamping plates 35 and 36 to frictionally engage the web 34.

As illustrated best in FIGS. 4 and 6, the second hinge member 24 may be of a substantially square W cross-section having an upstanding central rib 43. This type of hinge member is used with a relatively thick door and the upper ends of the side walls of the hinge member are provided with outwardly extending flanges 44. Each of such flanges has openings 45 through which conventional screws or other fasteners extend to secure the hinge member 24 to the door. When this embodiment is to be used, a cooperating recess 46 (FIG. 4) is provided in the structure of the door 21. A portion of the longitudinally extending central rib 43 of the hinge member 24 is located adjacent to the lugs 27 and such rib is provided wtih an arcuate control slot 47 in which the guide pin 28 of the first hinge member 23 is slidably received. The shape of the arcuate control slot 47 is formed in any desired curvature in accordance with a selected path of movement of the hinged or trailing edge of the door 21.

As illustrated in FIG. 7, when the second hinge member 24 is to be used with a relatively thin door, such hinge member may have an inverted T-shaped cross-section with openings 45 spaced along the base portion thereof. In this embodiment, the second hinge member is mounted on the inner surface of the door 21 and the recess 46 is omitted.

A generally U-shaped connecting link 48 having elongated substantially parallel arms 49 is swingably mounted between the side walls 25 of the first hinge member 23 by a pivot pin 50 adjacent to the bight portion of the link. The arms 49 straddle the central rib 43 of the second hinge member 24 and are pivotally connected thereto by a pin 51 which passes through an opening 52 in such rib. In order to provide clearance when the door 21 is opened, the arms 49 of the link 48 may have a generally arcuate configuration, as illustrated in FIGS. 3 and 9–13, or, if desired, such link arms could have an angular configuration similar to a bell crank. It is apparent that the first hinge member 23 is slidably connected to the second hinge member 24 by the pin 28 located within the control slot 47 and that one end of the link 48 is pivotally connected to the first hinge member by the pin 50 while the other end of such link is pivotally connected to the second hinge member by the pin 51.

Relative movement between the arcuate control slot 47 and the associated guide pin 28 causes the link 48 to swing about the pins 50 and 51 and confines both the leading and trailing edges of the door 21 to rationally chosen desired paths. The shape of the arcuate control slot 47 ordinarily is determined by plotting a selected path for the trailing edge of the door and relating the necessary positions of the pins 50 and 51 and the link 48 to a set of coordinate points along the central rib 43. Therefore, relative movement between the slot 47 and the guide pin 28 transmits the information contained in the bearing surfaces of the control slot to the pivot pins and link thus necessarily recreating the selected paths of movement of the leading and trailing edges of the door.

In order for the leading and trailing edges of the door to follow the same controlled path each time the door is moved, the guide pin 28 and the pivot pin 50 are spaced apart a fixed predetermined distance, the pivot pins 50 and 51 are spaced apart a fixed predetermined distance, and the distance between the guide pin 28 and the pivot pin 51 is variable. As a specific example, the distance between the guide pin 28 and the pivot pin 50 may be 1.063 inches (26.988 mm) and the distance between the pivot pins 50 and 51 may be 0.750 inches (19.050 mm).

In the example shown in FIGS. 3 and 9–13, the control slot 47 has been plotted so that during the initial movement of the door the hinges cause the trailing edge of the door to move out of abutting relationship with the panel 22 in a short motion which permits minimal clearance requirements between the door 21 and the panel 22. The portion of the slot 47 which controls this motion, accelerates the door at a relatively low rate as a compromise between the desired clearing action and the maintenance of a normal "feel" to the door. Continued opening movement directs the trailing edge of the door away from the mounting panel and allows normal rotation of the leading edge of the door as the connecting link 48 pivots or swings about the pins 50 and 51 and the control slot 47 slides past the pin 28. The final motion of the hinges directs the trailing edge of the door toward the hinges as the door passes 90° of the opening and terminates at a maximum open position at approximately 115° when the end of the slot 47 engages the pin 28.

In the operation of this embodiment of the invention the second hinge member 24 is mounted within the recess 46 of the door 21 or on the inner surface thereof, depending upon the configuration of the hinge member and the particular door. The mounting member 31 is secured to the panel or post 22 in a desired position and thereafter the flanges 29 of the first hinge member 23 are inserted into the slots 30 after which the first hinge member is located in a desired position and the screw 37 or 37' is tightened so that at least one of the clamping plates 35 or 36 intimately engages the web 34 to secure the first hinge member in fixed position. When the leading edge of the door which is opposite the hinges, is moved outwardly, as in opening the door, the control slot 47 is moved relative to the fixed guide pin 28 while simultaneously the connecting link 48 is pivoted about the pins 50 and 51. Since the pins 28, 50 and 51 are arranged in a generally triangular relationship with each other, the connecting link 48 and the control slot 47 control the motion and position of the door as the door is opened.

Figure 14:
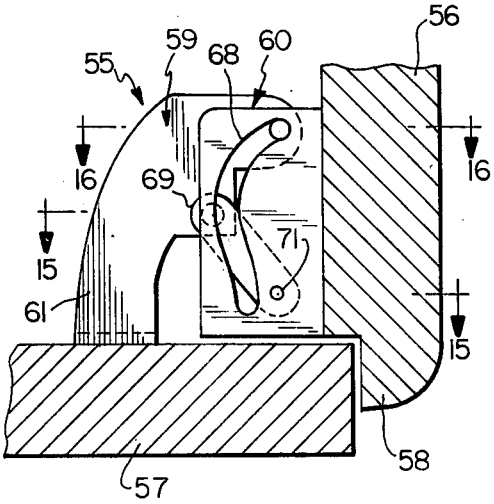
FIG. 14 is a top plan view of another embodiment of the invention in use with an overset door.
Figure 15:
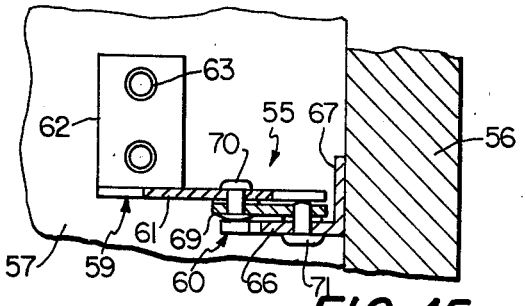
FIG. 15 is a sectional view on the line 15—15 of FIG. 14.
Figure 16:
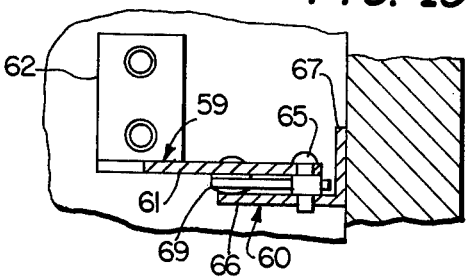
FIG. 16 is a sectional view on the line 16—16 of FIG. 14.
Figure 17:
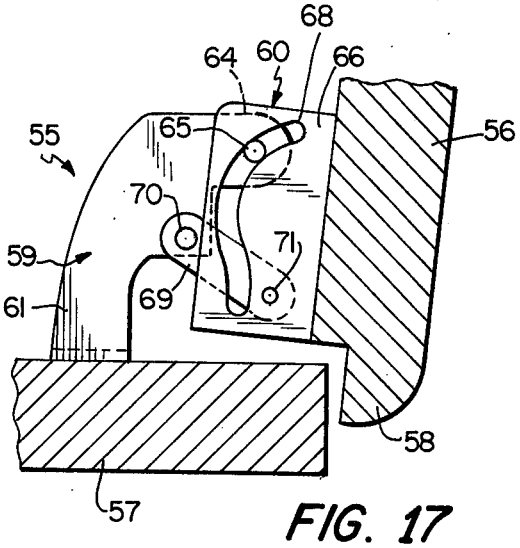
FIGS. 17–21 are plan views similar to FIG. 14 showing different positions of the hinge members while the overset door is being opened.
Figure 18:
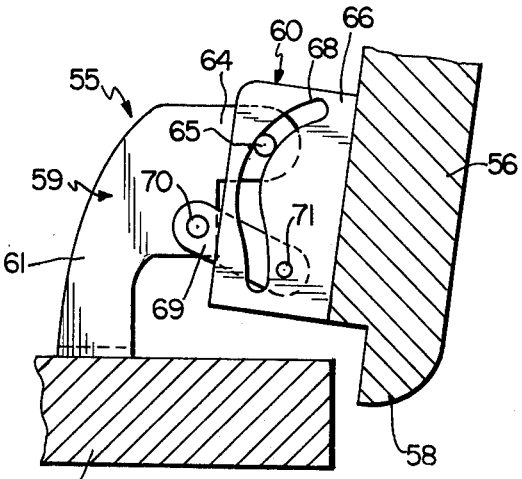
Figure 19:
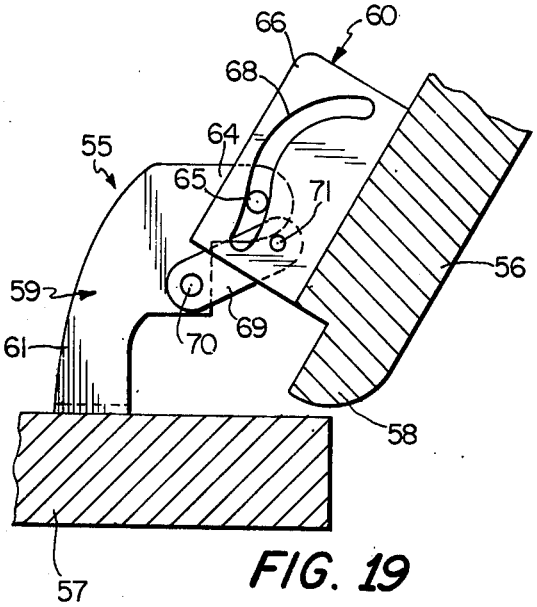
Figure 20:
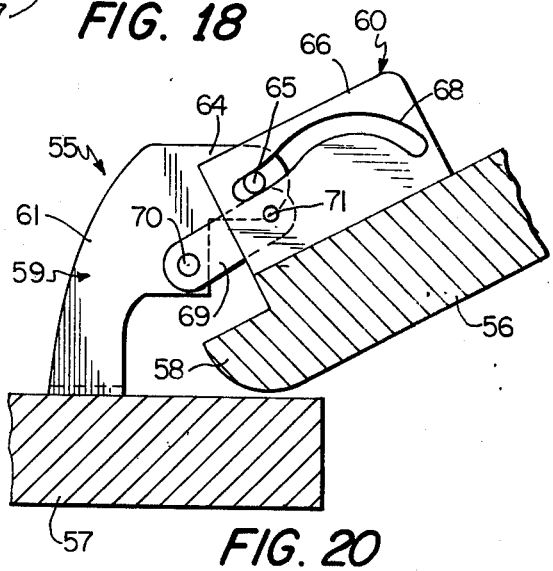
Figure 21:
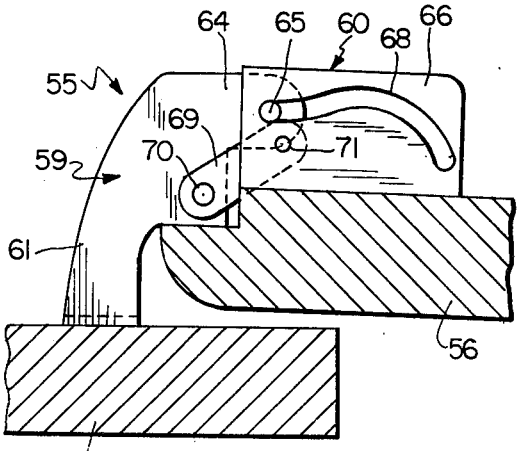

With particular reference to FIGS. 14–21, a modified embodiment of the invention is provided including hinges 55 which are used for mounting an overset door 56 on a panel or post 57. In this embodiment the door 56 includes a lip 58 which overlies opposite sides only of the opening in the panel 57 when the door is in closed position but does not overlie the top and bottom. Each of the hinges 55 includes a first hinge member 59 which is mounted on the panel 57 and a second hinge member 60 which is mounted on the door 56. The first hinge member 59 includes a body 61 having an angularly disposed base 62 with openings 63 for receiving screws or other fasteners by which the first hinge member is secured to the panel 57. The upper end of the first hinge member 59 terminates in a lug 64 having a pin 65 mounted thereon generally normal to the plane body 61.

The second hinge member 60 includes a body 66 having a right angle flange 67 by means of which the second body is mounted on the door 56. A portion of the body 66 is located adjacent to the lug 64 of the first hinge member 59. The body 66 is provided with a control slot 68 which slidably receives the pin 65 when the door is moved relative to the panel 57. A connecting link 69 is pivotally attached at one end to the body 61 by a pin 70 and is pivotally attached at the other end to the body 66 by a pin 71.

In the operation of this embodiment of the invention, when the side of the door remote from the hinges is initially opened, the remote edge of the door accelerates while the control slot 68 moves past the pin 65 at a relatively low rate. Continued opening movement of the door causes the connecting link 69 to swing the body 66 outwardly so that the lip 58 moves along the edge of the panel 57 without contacting the same. The control slot 68 and the connecting link 69 continue to control the movement of the door so that when the lip 58 along the trailing edge of the door is disposed within the limits of the opening in the panel 57, the control slot and the connecting link cause the trailing edge of the door to swing inwardly generally parallel with the inner surface of such panel. The inward movement of the trailing edge of the door continues while the door is being opened until the door is positioned at an angle of approximately 90° from its starting position at which time the pin 65 reaches the end of the control slot 68 and stops any further movement of the door.

I claim:

1. Hinge means for mounting a closure member on a fixed structure having an opening in a manner to entirely conceal the hinge means when the closure member is closed, comprising a first hinge member, means for adjustably mounting said first hinge member on one of said closure member and fixed structure including a base having at least one slot, said first hinge member having flange means slidably mounted in said slot, said base having an upstanding web extending lengthwise thereof, a clamping plate carried by said first hinge member, and means for moving said clamping plate into clamping engagement with said web to hold said first hinge member in fixed position relative to said base, a second hinge member fixed to the other of said closure member and fixed structure, guide pin means mounted on a portion of said first hinge member, a portion of said second hinge member being located adjacent to the portion of said first hinge member having said guide pin means, said portion of said second hinge member having a control slot which slidably receives said guide pin means, a connecting link means swingably connected at one end to said first hinge member and swingably connected at the other end to said second hinge member, said swingable connections of said connecting link being in spaced relationship with said guide pin means and said slot at all times so that said hinge means controls the motion of said closure member when said closure member is moved.

2. The structure of claim 1 in which said control slot and said cooperating link means are arranged in a manner to locate one side of said closure member within said fixed structure when said closure member is opened.

3. Hinge means for mounting a door on a fixed structure having an opening in a manner to entirely conceal the hinge means when the door closes the opening of said structure, said hinge means comprising a first hinge member, means for adjustably mounting said first hinge member on said fixed structure inwardly of said opening, including a base having longitudinally extending slots along opposite sides, said first hinge member having spaced generally parllel side walls with inwardly extending flanges adjustably received within the slots of said base, an upwardly extending web mounted on said base, at least one clamping plate located between said side walls, and means for selectively moving said clamping plate into clamping engagement with said web to hold said first hinge member in fixed adjusted position, said first hinge member having an outwardly extending portion with a guide pin mounted thereon, a second hinge member, means for mounting said second hinge member in fixed position on said door, said second hinge member having an upstanding rib with an arcuate control slot therein, at least a portion of said rib being in side-by-side relationship with said outwardly extending portion of said first hinge member so that said guide pin is located within said control slot, a connecting link swingably connected at one end to said first hinge member and swingably connected at the other end to said second hinge member, said swingable connections of said connecting link being in spaced relationship with said guide pin and said control slot at all times so that said hinge means controls the motion of said door when said door is moved and positions at least a portion of the door within the opening of the fixed structure when the door is opened.

* * * * *